US005642808A

United States Patent [19]

Marco et al.

[11] Patent Number: 5,642,808

[45] Date of Patent: Jul. 1, 1997

[54] INDIVIDUAL APERTURE—CONTINUOUS ZIP STRIP

[75] Inventors: Leslie S. Marco, Bloomingdale; Robert C. Olsen, Medinah, both of Ill.

[73] Assignee: Illinois Tool Works Inc., Glenview, Ill.

[21] Appl. No.: 608,522

[22] Filed: Feb. 28, 1996

[51] Int. Cl.[6] ..... B65D 75/00

[52] U.S. Cl. ..... 206/150; 206/151; 206/428; 294/87.2

[58] Field of Search ..... 206/139, 150, 206/151, 152, 158, 169, 199, 428; 294/87.2, 87.28

[56] References Cited

U.S. PATENT DOCUMENTS

| | | | |
|---|---|---|---|
| 3,038,602 | 6/1962 | Rapata . | |
| 3,204,386 | 9/1965 | Creed et al. . | |
| 4,250,682 | 2/1981 | Braun . | |
| 5,020,661 | 6/1991 | Marco | 206/150 |
| 5,060,999 | 10/1991 | Marvin | 206/150 |
| 5,072,829 | 12/1991 | Marco et al. | 206/150 |
| 5,115,910 | 5/1992 | Klygis et al. | 206/150 |
| 5,174,441 | 12/1992 | Marco . | |
| 5,178,266 | 1/1993 | Villa | 206/150 |
| 5,193,673 | 3/1993 | Rathbone et al. | 206/150 |
| 5,265,718 | 11/1993 | Marco | 206/150 |
| 5,441,148 | 8/1995 | Appleton | 206/150 |

*Primary Examiner*—Paul T. Sewell
*Assistant Examiner*—Luan K. Bui
*Attorney, Agent, or Firm*—Trexler, Bushnell, Giangiorgi & Blackstone, Ltd.

[57] ABSTRACT

A carrier device for carrying a plurality of containers, such as bottles, cans and the like, includes novel zip strips which can be selectively separated from the carrier device so that the containers held by the carrier device can be easily removed from the carrier device. The carrier device includes container engaging portions, each of which includes bands which define apertures therein for engaging the side walls of the containers to hold the containers therein to form a package. Each container engaging portion has a continuous outer margin portion. Each zip strip is positioned on the respective outer margin portion. The zip strip is separated from the remainder of the carrier device by a series of perforation lines, elongated slits and openings, along which the zip strip can be torn.

8 Claims, 2 Drawing Sheets

INDIVIDUAL APERTURE—CONTINUOUS ZIP STRIP

BACKGROUND OF THE INVENTION

This invention is generally directed to a carrier device which is used to secure containers together to form a package having novel zip strips for allowing the quick and easy removal of the containers from the carrier device one at a time or in rapid succession.

Currently, several types of carrier devices can be found in the art for securing containers together into a package. Some of these carrier device provide quick release structure for allowing a consumer to quickly and easily release the containers from the carrier device.

One such carrier device can be found in U.S. Pat. No. 3,038,602 which discloses a container carrier device that holds six cans in a package array. The carrier device is positioned near the top of each can. A zipper strip is provided on the carrier device and is positioned between the rows of cans. A consumer releases the cans from the carrier device by tearing the zipper strip. When the zipper strip is torn, the carrier device creates two sets of packages, each consisting of three cans.

One problem which arises with this type of quick release carrier device is that when the zipper strip is torn, two separate packages are formed which may be undesirable for handling the cans.

Another such carrier device can be found in U.S. Pat. No. 5,174,441 which discloses a tear-open container carrier device that holds a plurality of cans in a package. Each can is held within a container encircling band. Zip strips are provided on the carrier device exterior to the container encircling bands. A consumer releases the cans from the carrier device by tearing the zip strips. The removal of the strip ruptures each individual band.

The present invention presents a novel quick release structure or zip strip for a carrier device which allows the containers to be released from the carrier device one at a time or in succession.

OBJECTS AND SUMMARY OF THE INVENTION

A general object of the present invention is to provide a plastic carrier device for carrying a plurality of containers, such as bottles, cans or the like, which includes at least one novel zip strip which allows a consumer to easily and quickly remove containers from the carrier device.

An object of the present invention is to provide a carrier device which has novel zip strips which can be used to quickly and easily release the containers from the carrier device one at a time or in rapid succession.

A further object of the present invention is to provide a carrier device which is sturdy while allowing containers to be easily and quickly released from the carrier device.

Briefly, and in accordance with the foregoing, the present invention discloses a carrier device for carrying a plurality of containers, such as bottles, cans or the like, which includes novel zip strips that can be substantially separated from the remainder of the carrier device so that the containers held by the carrier device can be easily and quickly removed from the carrier device. The containers can be released one at a time or in rapid succession.

The carrier device includes container engaging portions, each of which includes annular rings or bands which define apertures therein for engaging the side walls of the containers to hold the containers therein to form a package. The outer margins of the apertures are contoured.

Each ring or band has an inner margin portion, an outer margin portion and side margin portions. The inner margin portions of adjacent bands are joined together and side margin portions of adjacent bands are joined together. Each zip strip is positioned on the outer margin portions of the bands. Each zip strip is substantially separated from the remainder of the carrier device by a plurality of perforation lines, slits and openings. The openings are positioned along the outer margin of the carrier device between adjacent apertures.

A first perforation line starts at a side margin of the carrier device and extends inwardly therefrom and substantially to the first aperture. A first slit is generally aligned with a portion of the perforation line and is separated from the perforation line by a narrow web of carrier device material. One of the openings is substantially aligned with the slit and separated therefrom by a narrow web of carrier device material.

A second perforation line starts on the opposite side of the opening and extends across the outer margin of the carrier device and substantially to the middle aperture. A second slit is substantially aligned with a portion of the second perforation line and is separated from the second perforation line by a narrow web of carrier device material. The other of the openings is substantially aligned with the second slit and separated therefrom by a narrow web of carrier device material.

Finally, a third perforation line starts on the opposite side of the second opening and extends across the outer margin of the carrier device and substantially to the third aperture.

It is to be noted that as shown and described herein, the carrier device has three apertures. The present invention is not intended to be so limited and the carrier device can be formed to include two or more apertures in accordance with the present invention.

Each zip strip can be torn along the first perforation line to direct the tearing forces inwardly to the first aperture in order to release the container held therewithin. The narrow web of carrier device material between the perforation line and the opening is ruptured as the zip strip is pulled. The zip strip separates itself from the remainder of the carrier device along the slit and thereafter, the narrow web of material between the opening and the second perforation line can be selectively ruptured to release the container in the middle aperture. Thereafter, the same process is repeated for releasing the subsequent containers from the carrier device.

It should be understood that the openings between the slits and subsequent perforation line could be eliminated and the subsequent perforation line could be directly interconnected to the prior adjacent slit.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENT

Figure 1:
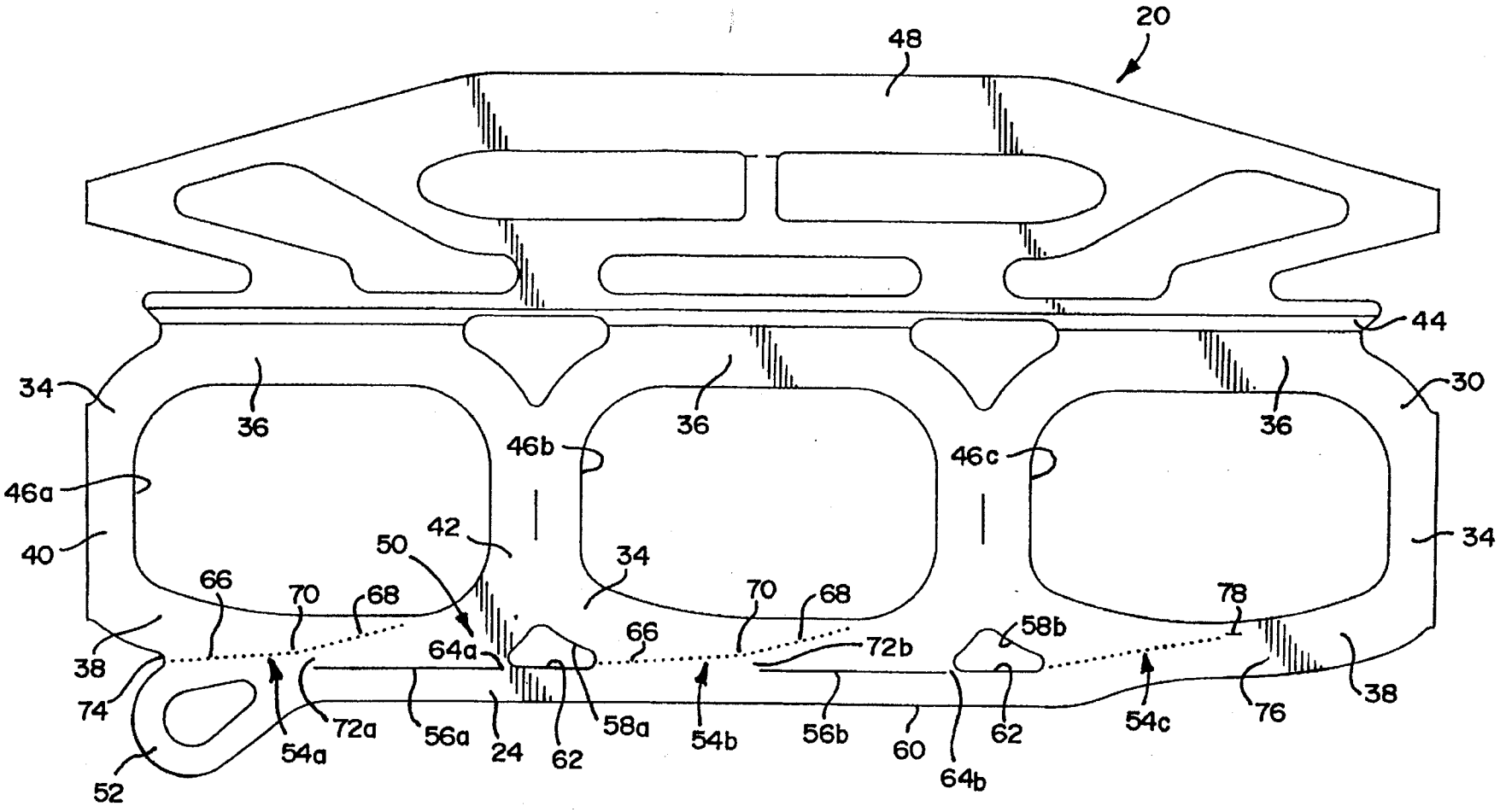
FIG. 1 is a side elevational view of a carrier device having zip strips which incorporates the features of the invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

As shown in the drawings, a multi-packaging device or carrier device 20, constructed according to the teachings of the present invention, is used to hold a plurality of containers 22. The carrier device 20 includes at least one novel zip strip 24 which can be pulled to easily and quickly release the containers 22 held within the carrier device 20. The zip strip 24 can be pulled so as to release the containers 22 one at a time or to release all of the containers 22 in rapid succession.

Figure 2A:
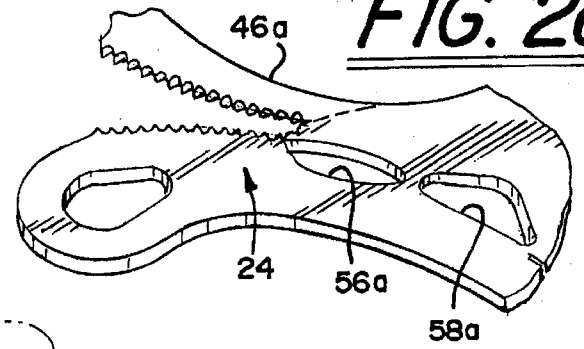
FIG. 2*a* is a partial, enlarged perspective view of the carrier device shown in FIG. 2 showing the zip strip being partially torn.
Figure 3:
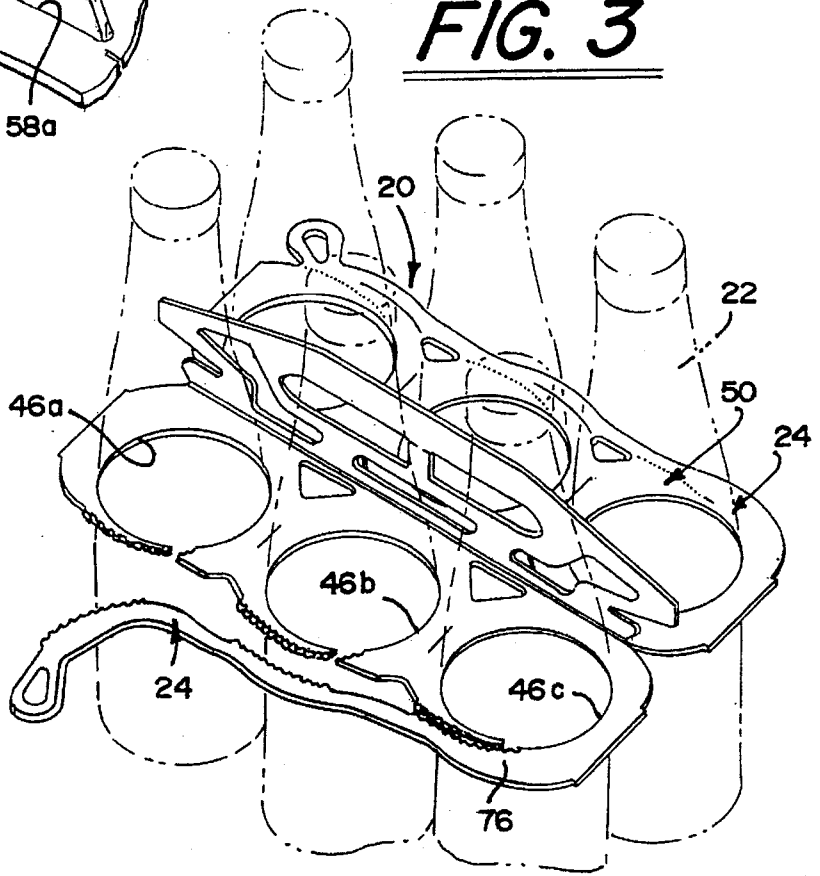
FIG. 3 is a perspective view of the carrier device shown in FIG. 1 shown surrounding a plurality of containers with the zip strip fully torn to release all of the containers therefrom.
Figure 2:
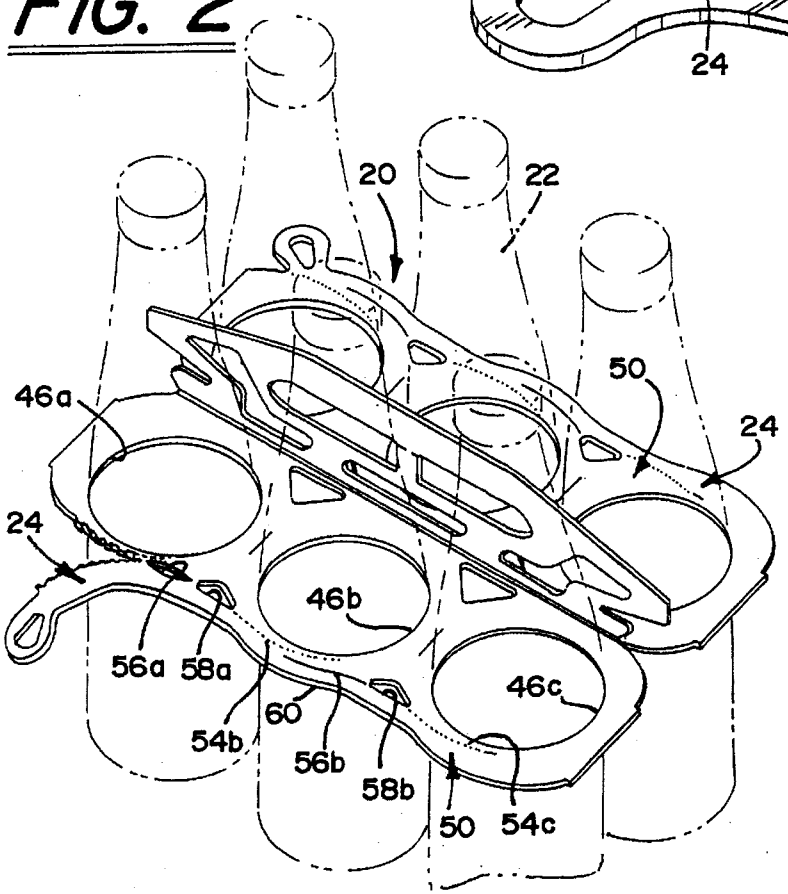
FIG. 2 is a perspective view of the carrier device shown in FIG. 1 shown surrounding a plurality of containers with the zip strip being partially torn.

As shown in FIG. 2, the carrier device 20 is used to carry six bottles 22 to form a package 26. It is to be understood that other types of containers can be carried by the carrier device 20, such as cans or the like.

A preferred embodiment of the general structure of the carrier device 20 and the method for forming the same is disclosed in U.S. patent application Ser. No. 08/230,308 entitled "Container Carrier device" and owned by the assignee herein and which disclosure is incorporated herein by reference. The carrier device 20 is made of a suitable flexible, resilient, stretchable material, such as plastic. Preferably, the carrier device 20 is made of a low density polyethylene so that the carrier device 20 can be stretched over the containers 22 and conform to side walls 28 of the containers 22. The carrier device 20 may be applied to the containers 22 by known means, for example, by the machines disclosed in U.S. Pat. Nos. 4,250,682 or 3,204,386.

When the containers 22 are secured in a package arrangement by the carrier device 20, the containers 22 are aligned in an array so to form two rows. As shown, each row has three bottles. It is to be understood that the carrier device 20 operates equally well with any number of containers.

The carrier device 20 includes container engaging portions 30, 32, each formed from a plurality of annular rings or bands 34. Each band 34 has an inner margin 36, an outer margin 38 and side margins 40, 42 which connect the inner margin 36 of each band 34 to the outer margin 38 of the same band 34. The side margins of adjacent bands 34 are integrally joined together so that the outer margins 38 of the bands 34 are continuous and uninterrupted along the length of the carrier device 20.

The bands 34 are connected or joined together by a seam or a joined portion 44 along the inner margins 36 of each band 34. The annular bands 34 define a plurality of shaped apertures 46*a*, 46*b*, 46*c* for securely holding the containers 22 therein as shown in FIG. 2. The outer margin of each aperture 46*a*, 46*b*, 46*c* is slightly contoured.

The container engaging portions 30, 32 freely extend from the joined portion 44. The joined portion 44 is generally planar with the plane of the container engaging portions 30, 32 when the carrier device 20 is not assembled with containers 22 and projects generally perpendicular to the plane of the container engaging portions 30, 32 when the carrier device 20 is assembled with the containers 22.

The joined portion 44 is formed by extruding a strip or layer of resilient, stretchable material, such as plastic, preferably low density polyethylene material, between the inner margins 36 of each annular band 34 and thereafter sufficiently melting and merging the inner margins 36 of the container engaging portions 22, 24 and the layer of extruded plastic together by known means, preferably by heat sealing and fusing the layers together, to form a strong, integral bond. The joined portion 44 may be partially interrupted along its length by cutouts.

The carrier device 20 includes a handle portion 48 which extends upwardly from the joined portion 44 of the carrier device 20. The handle portion 48 includes two sides portions which are formed from the two sheets that are used to form the carrier device 20. A bond (not shown), formed by heat sealing or by extruding a layer of plastic material between the side portion, may be provided along an upper portion of the handle portion 48 to prevent the side portions of the handle portion 48 from separating thereby making the handle portion 48 easy to grasp by a consumer. Alternatively, the carrier device 20 can be constructed without a handle portion 48.

The zip strip 24 on each container engaging portion 30, 32 is positioned along the outer margin 38 of each container engaging portion 30, 32 for releasing containers 22 from the carrier device 20 one at a time while maintaining the remainder of the containers 22 in the package 26, or for releasing the containers 22 in each row from the carrier device 20 in rapid succession. The zip strip 24 is used to completely rupture each aperture 46*a*, 46*b*, 46*c* to release the containers 22 held within the bands 34 of the carrier device 20. Each zip strip 24 is separated from the remainder of the respective container engaging portion 30, 32 by a separating structure 50.

At one end of each zip strip 24, a tab portion 52 is provided for a consumer to grasp the portion 52 to initiate tearing of the respective zip strip 24. The tab portion 52 clearly denotes to a consumer the starting end of the zip strip 24 and may include an aperture therethrough through which a consumer can place a finger for tearing the zip strip 24.

The separating structure 50 includes perforation lines 54*a*, 54*b*, 54*c*, one of each which is associated with a respective aperture 46*a*, 46*b*, 46*c* in the respective container engaging portion 30, 32. In addition, the separating structure 50 includes elongated slits 56*a*, 56*b* and openings 58*a*, 58*b* as described herein.

The openings 58*a*, 58*b* are provided along the outer margin 38 of the respective container engaging portion 30, 32 midway between adjacent apertures. That is, opening 58*a* is provided between aperture 46*a* and aperture 46*b*; opening 58*b* is provided between aperture 46*b* and aperture 46*c*. Each opening 58*a*, 58*b* is spaced from the outermost side edge 60 of the respective container engaging portion 30, 32. Each opening 58*a*, 58*b* is generally triangular in shape, with the elongated side 62 of the triangle being generally adjacent to the outer side edge 60 of the container engaging portion 30, 32. The openings 58*a*, 58*b* are formed in the container engaging portions 30, 32 by suitable known means.

Each elongated slit 56*a*, 56*b* is provided along the outer margin 38 of the container engaging portion 30, 32 between each opening and the respective perforation line. That is, slit 56*a* is between opening 46*a* and perforation line 54*a*; slit 56*b* is between opening 46*b* and perforation line 54*b*. Each elongated slit 56*a*, 56*b* is generally adjacent to and spaced from the outer side edge 60 of the respective container engaging portion 30, 32. In addition, the end of each slit 56*a*, 56*b* which is proximate to the respective opening 58*a*, 58*b* is separated from the respective opening 58*a*, 58*b* by a narrow web 64*a*, 64*b* of material. The slits 56*a*, 56*b* are formed in each container engaging portion 30, 32 by suitable known means.

The perforation lines 54*a*, 54*b*, 54*c* may be formed from a series of spaced dots or, alternatively, a series of spaced short lines. Each dot in each perforation line 54*a*, 54*b*, 54*c* is separated from each other by a continuous, uninterrupted portion of the carrier device 20. The perforation lines 54*a*, 54*b*, 54*c* do not significantly reduce package integrity while facilitating tearing of the zip strips 24 on each side of the carrier device 20. The perforation lines 54*a*, 54*b*, 54*c* are formed by suitable known means.

The perforation lines 54*a*, 54*b* which are associated with the first and second apertures 46*a*, 46*b* each have a first portion 66 which extends at a slight angle relative to the side edge 60 of the container engaging portion 30, 32 and a second portion 68 which extends from the end of the first portion 66 toward the respective aperture 46*a*, 46*b* and ends proximate to the respective aperture 46*a*, 46*b*. The first and second portions 66, 68 meet at junction 70. The second portion 68 is angled relative to the first portion 66.

The perforation line 54*a* which is associated with the first aperture 46*a*, i.e. the aperture 46*a* which is closest to the start of the zip strip 24, starts at an end 74 of the container engaging portion 30, 32. The perforation line 54*b* which is associated with the middle aperture 46*b* is positioned between the opening 58*a* and the slit 56*b*. The middle perforation line 54*b* starts proximate to the opening 46*a*. Each slit 56*a*, 56*b* is separated from the respective perforation line 54*a*, 54*b* by a continuous section 72*a*, 72*b* of carrier material which is frangible as described herein. The frangible section 72*a*, 72*b* is the width of carrier material which is between the respective perforation line 54*a*, 54*b* and the respective slit 56*a*, 56*b*.

The perforation line 54*c* proximate to the last aperture 46*c*, i.e. the aperture 46*c* which is closest to the end of the zip strip 24, starts proximate to the opening 58*b* and angles toward the aperture 46*c*. The perforation line 54*c* ends proximate to the aperture 46*c*. A slit is not provided adjacent to the last perforation line 54*c* because the zip strip 24 is not designed to be completely torn away from the remainder of the carrier device 20. Instead, the strip 24, after being torn as described herein, is integrally joined with the remaining portion of the carrier device 20 at point 76. Therefore, when the strip 24 is torn along its separating structure 50, the strip 24 remains attached to the carrier device 20 at point 76 and does not separate into a distinct, discardable device. Of course, if desired, the separating structure 50 can be modified so that the zip strip 24 completely separates from the remainder of the carrier 20.

In addition, between the end of the last perforation line 54*c* and the last aperture 46*c*, a single slit 78 may be provided to aid in directing the tearing forces inwardly into the last aperture 46*c* when the strip 24 is torn to free the container 22 held therewithin. The slit 78 is generally parallel to the side edge 60 of the carrier device 20 and is spaced from the end of the perforation line 54*c* and from the aperture 46*c* by a continuous portion of the carrier device 20. The slit 78 is formed by suitable means. The slit 78 may be slightly angled relative to the perforation line 54*c* and may be provided in association with any of the perforation lines. Alternatively, a pair or more of staggered slits may be provided between the end of any of the perforation lines and the respective aperture. The slits can be parallel to or angled relative to the side edge of the carrier device. Of course, no slits may be provided such that the last perforation line is identical to the other perforation lines.

The separating structure 50 permits a consumer to tear the zip strip 24 to substantially separate the strip 24 from the remainder of the respective container engaging portion 30, 32. The zip strip 24 may be torn to release the containers 22 from the package 24 array one at a time so as to maintain the remainder of the containers 22 in the package array, or in rapid succession one after another. If the containers 22 are released one at a time, the remainder of the containers 22 are retained in the package array by the untorn portion of the zip strip 24 so as to not separate from each other. The ability of the consumer to rupture one aperture 46*a*, 46*b*, 46*c* at a time prevents the containers 22 from becoming dislodged uncontrollably when the consumer wants to open the package 26.

Attention is now directed to FIGS. 2 and 2*a*. To release the first container 22 from the carrier device 20, the consumer grasps the tab portion 52 of the zip strip 24 and pulls in the direction of the first perforation line 54*a*. The perforation line 54*a* ruptures to start to separate the zip strip 24 from the remainder of the container engaging portion 30, 32 and the tearing forces are directed inwardly into the aperture 46*a* to completely rupture the aperture 46*a* which releases the container 22 in that aperture 46*a* while retaining the remainder of the containers 22 in all other apertures 46*b*, 46*c*. After the aperture is ruptured, continued or subsequent pulling force acts on the zip strip 24 so the tension on the outer margin 38 of the container engaging portion 30, 32 causes the narrow frangible section 72*a* between the perforation line 54*a* and the slit 56*a* to rupture. During this tensioning, the slit 56*a* widens and provides the ability of the frangible section 72*a* to accept the high stresses and still rupture. In addition, the slit 56*a* allows the pulling force to be concentrated across the frangible section 72*a*. If the slit 56*a* were not there, or were not elongated as shown, there would be little ability of the frangible section 72*a* to rupture. Additionally, if the slit 56*a* were replaced with perforations, the same function is not achieved and the frangible section 72*a* does not rupture.

To release the second container 22 from the carrier device 20, the consumer continues to pull the zip strip 24 along the length of the carrier device 20. The zip strip 24 is separated from the remainder of the container engaging portion 30, 32 along the slit 56*a*. As the consumer continues to pull the zip strip 24, the narrow web 64*a* between the slit 56*a* and the opening 58*a* is ruptured by the tension. This separates the zip strip 24 from the remainder of the container engaging portion 30, 32 along the opening 58*a*. Thereafter, as the consumer continues to pull on the zip strip 24, the middle perforation line 54*b* is ruptured. The shape of the opening 58*a* aids in rupturing the start of the perforation line 54*b* by directing the tearing forces into the perforation line 54*b*. When the middle perforation line 54*b* ruptures, the tearing forces are directed inwardly into the middle aperture 46*b* to completely rupture the middle aperture 46*b* to release the container 22 in that aperture 46*b* while retaining the last container 22 in the last aperture 46*c*. As the pulling force is applied to the zip strip 24, the tension on the outer margin 38 of the container engaging portion 30, 32 causes the slit 56*b* to widen and the narrow frangible section 72*b* between the middle perforation line 54*b* and the middle slit 56*b* to rupture.

To rupture the last aperture 46*c* to release the container 22 held therewithin, the consumer continues to pull the zip strip 24 along the length of the carrier device 20. The zip strip 24 is separated from the remainder of the container engaging portion 30, 32 along the slit 56*b*. As the consumer continues to pull the zip strip 24, the narrow web 64*b* between the slit 56*b* and the opening 58*b* is ruptured and the zip strip 24 is separated from the remainder of the container engaging portion 30, 32 along the opening 58*a*. Thereafter, as the consumer continues to pull on the zip strip 24, the last perforation line 54*c* is ruptured. The shape of the opening 58*b* aids in rupturing the start of the perforation line 54*c* by directing the tearing forces into the perforation line 54*c*. When the last perforation line 54*c* ruptures, the tearing forces are directed inwardly into the last aperture 46*c* to completely rupture the last aperture 46*c* and to release the container 22 held therein. The zip strip 24 remains attached to the remainder of the container engaging portion 30, 32 at point 76.

As shown in the drawings, the zip strips 24 both start at the same end of the carrier device 20. It is to be understood that the zip strips 24 may start at opposite ends of the carrier device 20.

In addition, more than one middle aperture 46*b*, along with its associated separating structure 50 as described herein, may be provided in the carrier device 20. For example, if the carrier device 20 includes two middle apertures, the opening, perforation line and slit which are provided for the middle aperture shown in the drawings, are repeated for the other middle aperture.

Alternatively, the carrier device 20 can be formed from a flat, planar blank which can include a side handle, such as the one disclosed in Ser. No. 08/522,866 which is commonly owned by the assignee herein and which disclosure is herein incorporated by reference.

While a preferred embodiment of the present invention is shown and described, it is envisioned that those skilled in the art may devise various modifications of the present invention without departing from the spirit and scope of the appended claims.

The invention claimed is:

1. A carrier device for carrying a plurality of containers comprising: at least one container engaging portion formed from a flexible material, said container engaging portion comprising a plurality of bands disposed in a row, each said band defining an aperture therein for holding a single container therein, said bands having an outer margin portion extending longitudinally of said row, separating means on said outer margin portion for separating a separable portion of said outer margin portion from the remainder of said outer margin portion, said separable portion defining a zip strip, said separating means comprising a perforation line respectively associated with and inwardly directed towards each said aperture and an elongated slit between adjacent perforation lines, each said perforation line directing tearing forces into the respective apertures, said tearing forces being formed by pulling said zip strip to separate said zip strip from the remainder of the outer margin portion along said perforation lines and said slits.

2. A carrier device as defined in claim 1, wherein each said slit is separated from one of said adjacent perforation lines by a narrow web of material which can be ruptured when said zip strip is pulled.

3. A carrier device as defined in claim 2, further including an opening respectively positioned between adjacent apertures in said container engaging portion and along said outer margin portion, each said opening being respectively positioned between one of said slits and one of said perforation lines and separated therefrom by a narrow section of material which can be ruptured when said zip strip is pulled.

4. A carrier device as defined in claim 2, further including two of said container engaging portions, and a handle portion connected to adjacent inner margins of said container engaging portions, and wherein each of said container engaging portions includes said bands at opposite ends of the respective container engaging portion and at least one intermediate band.

5. A carrier device as defined in claim 1, wherein predetermined ones of said perforation lines comprise a first portion and a second portion, each said first portion extending at a slight angle relative to a side edge of said outer margin portion and each said second portion extending from an end of said first portion and inwardly toward the respective aperture.

6. A carrier device as defined in claim 1, further including two container engaging portions.

7. A carrier device as defined in claim 1, further including a handle portion connected to said container engaging portion.

8. A carrier device as defined in claim 7, further including two container engaging portions and wherein said handle portion is connected to the inner margin of each said container engaging portion.

* * * * *